US005463806A

United States Patent [19]

Sacotte

[11] Patent Number: 5,463,806

[45] Date of Patent: Nov. 7, 1995

[54] METHOD FOR COMPACTING ELECTRICAL WINDINGS EQUIPPING TRANSFORMERS

[75] Inventor: Michel Sacotte, Ronbas, France

[73] Assignee: France Transfo, Maizieres-les-Metz, France

[21] Appl. No.: 148,533

[22] Filed: Nov. 8, 1993

Related U.S. Application Data

[63] Continuation of Ser. No. 961,618, Oct. 16, 1992, abandoned.

[30] Foreign Application Priority Data

Oct. 16, 1991 [FR] France ..... 91 12705

[51] Int. Cl.[6] ..... H01F 41/06

[52] U.S. Cl. ..... 29/605; 29/606

[58] Field of Search ..... 29/605, 598, 596, 29/606

[56] References Cited

U.S. PATENT DOCUMENTS 3,333,328 8/1967 Rushing ..... 29/605 X 3,407,489 10/1968 Gibbs ..... 29/596

*Primary Examiner*—Carl E. Hall

*Attorney, Agent, or Firm*—Pollock, Vande Sande & Priddy

[57] ABSTRACT

At least one electrically conducting wire is coated with an electrically insulating material and wound in non-tightly coiled turns in a uniform direction of rotation. A direct electrical current is passed in the turns of the winding, preferably by repetitive sequences interspersed with stop periods, so as to create therein electromagnetic forces of mutual attraction between the turns, tending to bring them closer together in pairs and thus to reduce the height of the winding.

5 Claims, No Drawings

METHOD FOR COMPACTING ELECTRICAL WINDINGS EQUIPPING TRANSFORMERS

This application is a continuation of application Ser. No. 07/961,618, filed Oct. 16, 1992 (now abandoned).

BACKGROUND OF THE INVENTION

The present invention relates to the construction of static-type inductive electrical apparatuses, especially power or distribution transformers, such as transformers, and relates more precisely to producing the wound coil for the electrically conducting windings equipping such apparatuses.

More precisely still, the invention applies specifically, but not limitingly, to "medium- or high-voltage" windings of transformers consisting of one or more electrically conducting wires, normally made of aluminum or copper, previously enameled or otherwise coated by an electrically insulating material, and wound in non-tightly coiled turns according to a rotation movement of uniform direction.

Within this scope, it relates to the compaction of the windings of this type once they are wound, so as to decrease the height thereof and, consequently, to reduce the cost of manufacturing the apparatus which is provided therewith.

DESCRIPTION OF THE PRIOR ART

One particular coil-winding technique of this kind is known, from EP 0,081,446, for windings of electrical transformers, which consists in continuously introducing a wire into an annular reception space in which it is put into turns which are formed by simple laying-down of the wire solely under the effect of gravity in order better to form therein stacks of spiralled flat disks each consisting of a layer of concentric turns.

A uniform rotation direction is preserved during the entire coil-winding process so that, during use of the apparatus, the electrical current flows in all the turns in the same direction. The operation is entirely controlled by a programmable automatic machine which imparts to the wire, at every instant, a pair of speeds (speed of feeding-into the reception space and speed of relative rotation with respect to the latter) adjusted to the laying-down of a turn at the desired position in the disk which is being formed, this being carried out solely under the effect of gravity, i.e. without the wire being subjected to significant traction or thrust forces.

This coil-winding-process technique is applicable without particular difficulty to aluminum or copper wires whose diameters range from less than 0.5 mm to more than 5 mm.

When the operation is correctly performed, the inevitable expansion of the turns within the winding remains quite small. Its effect on the apparent volume of the latter is completely acceptable, as the winding naturally becomes compacted slightly under the effect of its own weight.

Nevertheless, should the need arise, it is possible to reduce further the bulkiness in terms of height by a compaction operation which consists in compressing the winding at its ends by pressing down from above by means of a press or, more conventionally, by hand.

The use of a press assumes the availability of a range of thrusters which are adapted to the varied form of the windings manufactured and mounting the form which is appropriate as a function of the size of the winding to be compacted. This also requires operations for correctly presenting and moving the winding under the tool.

Intervention by a human operator (or even of several), who would use his hands for pressing down on the winding, has the drawback of a pinpointed thrust force which is necessarily limited in intensity and in duration. To this are added safety aspects which are all the more acute since hands are involved which are thus directly exposed to risks of injury.

Automatic compacting of electrical coils is known in the art, i.e., from U.S. Pat. No. 3,333,328 (Rushing). According to this patent, the coil is placed in the immediate vicinity of an electrically conductive body. Surges of electrical energy are then applied directly to the conductor turns (condenser discharge). Eddy currents created in the body produce an interaction between selected turn portions and the conductive body, producing electromagnetic repulsion forces which distance the turns from the body.

Apart from the fact that the method of Rushing requires the presence of an adjacent electrically conductive body, because of the very great inductance of the turns, it would be difficult to use where the coil comprises a large number of turn, as in the case of power or distribution transformers, i.e., those for which the present invention is used.

SUMMARY OF THE INVENTION

The object of the present invention is to effect a height compaction of the winding, after it has been wound, without intervention of external forces, and therefore without the aforementioned drawbacks.

For this purpose, the subject of the invention is a method of height compaction of an electrical winding equipping transformers, the winding being constituted by at least one electrically conducting wire coated with an electrically insulating material and wound in non-tightly coiled turns according to a rotation movement of uniform direction, in which a direct electrical current is caused to flow in the turns of the winding, after its coil-winding process, before it is mounted in the transformer which is to receive it.

As will doubtless have already been understood, the invention consists in applying the well-known law of physics in which two parallel conductors carrying electrical currents of the same direction are mutually attracted.

Under the action of such internal electromagnetic forces, the turns tend to approach each other in pairs. The overall effect is a decrease in the wasted spaces in the winding, which is manifested by a reduction in the apparent volume of the winding, especially its height, since these windings are generally longer than they are thick.

The intensity of the compaction current is the key factor. The force of mutual attraction depends in effect on the square of the value of this intensity. Of course, the latter is a function of the cross section of the conductor, but the current density must be at least in the range of 10 amp/mm$^2$ in order to produce a significant result, and preferably several tens of amp/mm$^2$, namely, of the order of 20–40 A/mm$^2$ specifically, in order to produce a fully satisfactory result.

In fact, tests have shown that, for wires less than 5 mm in diameter, for a current density of less than 10 A/mm$^2$, the electromagnetic compaction force risks being insufficient for effectively overcoming the interturn frictional forces.

There is no upper limit to the value of the intensity of the electrical compaction current according to the invention.

However, it is necessary to avoid excessive overheating of the winding, which would lead to degradation of the insulating coating and, consequently, to internal short-circuits.

Experiments show that an uninterrupted duration for passage of the current of several seconds, for example 1 to 5 sec., is appropriate. Of course, it is possible to repeat the operation several times, interspersed by short periods of cooling also lasting a few seconds. Moreover, a slight lengthening of the winding by a few millimeters is observed, just after stopping the current, doubtless due to a "spring" effect of the turns which relax after the attraction force disappears.

However, without being certain, it is highly possible that it is precisely on account of this phenomenon of relaxation of the turns by "spring" effect that the final compaction increases when the operation is carried out in successive sequences.

Further improved results can be obtained by setting the winding into mechanical vibration, either during the passage of the current, or during the periods of interruption, or during the entire compaction operation. The setting into vibration can be carried out simply with the aid of a vibrating plate serving as support for the winding.

The invention can be implemented very simply by applying an electrical direct-current voltage to the two prestripped ends of the winding.

It is important for the electrical current used to be a direct current. This current can be produced directly in this form, but more generally it will be a rectified alternating current.

The electrical power involved during the compaction depends, in fact, on the impedance of the wound coil, which impedance amounts solely to the electrical resistance for direct current. On the other hand, the use of an alternating current or, more generally a variable current would impose much too high a power on account of the large number of turns in this type of winding, and therefore of an impedance which is also very high.

In addition, in this case parasitic effects, which are difficult to control, could arise in the winding and counteract the compaction desired, as a result of induction phenomena which a variable current would not fail to generate in the immediate environment of the winding if there are electrical conductors there.

Specifically, it is desirable to constrain the winding laterally, for example by using a ferrule around it, so as to limit its external diameter to a desired value which otherwise would have the tendency of increasing slightly under the effect of the height compaction. It has been found to be advantageous to choose a metal ferrule, and therefore current conducting, as its smooth surface then offers minimum frictional resistance to the turns and thus facilitates the compaction better than.

DESCRIPTION OF THE PREFERRED EMBODIMENTS

Tests were carried out, inter alia, on a primary winding of a transformer of 3.5 MVA nominal power, constituted by a 2.65 mm diameter aluminum wire coated with a 0.06 mm thick enamel layer and having, in the as-wound state, a height of 630 mm. This height represented an "overdimension" of 15 mm which was to be eliminated by compaction.

In order to achieve this, the intensity of the direct current used was 150 A supplied at a voltage of 2000 V. The time of uninterrupted passage of the current was limited to a few seconds (about 2 or 3 sec.) and the operation was only performed once and on a non-vibrating support.

Following this operation, the desired decease, namely 15 mm, was observed in the height of the winding. This was comparable to the decrease obtained by manual thrust force whose magnitude is known to be of the order of 30 to 50 kgF, depending on the individual.

Generally, a height compaction effect of about 10% can be obtained by the implementation of the invention, and this optionally, after several repetitive sequences of passage of the current (three or four), which are interrupted by short stop periods in order to allow the winding to cool down and the turns to relax.

The invention is applicable to any electrical winding for a transformer or similar apparatus, having wasted internal voids due to the technique used for winding it in non-tightly coiled turns.

We claim:

1. A method of height compaction for an electrical winding equipping transformers and constituted by at least one electrically conducting wire coated with an electrically insulating material and wound in non-tightly coiled turns, according to a uniform direction of rotation, said method including the steps of:

(a) winding said wire in non-tightly coiled turns; and (b) generating an attractive force between said turns by passing a direct electrical current into said turns, for a period of about 1 to 5 seconds without interruption.

2. The method as claimed in claim 1, wherein said direct electrical current has a current density of at least 10 A/ram$^2$.

3. The method as claimed in claim 1, wherein several successive sequences of passage of said electrical current are carried out, interrupted by stop periods to permit said winding to cool down and said turns to relax.

4. The method as claimed in claim 3, wherein said winding is subjected to mechanical vibrations during and/or before said sequences of passage of said electrical current.

5. The method as claimed in claim 1, wherein said winding is laterally constrained in order to prevent expansion of an external diameter of said winding.

* * * * *